United States Patent [19]

Rostron et al.

[11] 4,139,751

[45] Feb. 13, 1979

[54] PUFFER-TYPE COMPRESSED-GAS CIRCUIT INTERRUPTER

[75] Inventors: Joseph R. Rostron, Monroeville; Charles F. Cromer, Penn Township, Allegheny County; Paul J. Yuran, Monroeville, all of Pa.

[73] Assignee: Westinghouse Electric Corp., Pittsburgh, Pa.

[21] Appl. No.: 616,703

[22] Filed: Sep. 25, 1975

[51] Int. Cl.[2] ..... H01H 33/88

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 3,551,626 | 12/1970 | Milianowicz | 200/148 A |
| 3,679,851 | 7/1972 | Latour et al. | 200/148 A |
| 3,745,281 | 7/1973 | Yoshioka | 200/148 A |
| 3,769,479 | 10/1973 | Leeds | 200/148 A |
| 3,839,613 | 10/1974 | Tsubaki et al. | 200/148 A |
| 3,909,572 | 9/1975 | Tsubaki et al. | 200/148 A |
| 3,941,962 | 3/1976 | Thaler | 200/148 A |

*Primary Examiner*—Robert S. Macon
*Attorney, Agent, or Firm*—W. A. Elchik

[57] ABSTRACT

An improved puffer-type gas-blast circuit-interrupter is provided having a movable operating cylinder assembly movable over a relatively-fixed piston structure. A high compression ratio is obtained during the opening operation by minimizing the "dead" volume of arc-quenching gas within the movable operating cylinder, and an efficient gas-flow path through the movable cylinder assembly smoothly converges through the movable nozzle throat-area into the drawn arc.

A high electrical withstand capability is accomplished by using a generous radius on the lower ends of external stationary main contact fingers, and by shrouding, or shielding the stationary contact probe within the surrounding shield of the stationary contact fingers.

The circuit-interrupter of the present invention is adapted for various current ratings, such as 2,000 amperes, 3,000 amperes, or 4,000 amperes, for example, by varying the number of stationary main contact fingers used surrounding the movable operating gas-cylinder.

High-interrupting performance is obtained with a reduced residual gas volume at the end of the opening stroke, and, consequently, a higher gas-compression ratio is obtained. The gas-flow downstream of the nozzle throat area is confined within the cluster of stationary main contact fingers, and this cools the ejected gas to prevent voltage breakdown to electrical members at another potential. Open venting ports are provided at the upper end of the stationary contact finger cluster to prevent stagnation of the hot arced gas flowing into the stationary contact finger cluster, which thereby permits the hot arcing gases to be blown out of the way to insure good interrupting performance and a high breakdown value.

8 Claims, 7 Drawing Figures

FULLY CLOSED

ARCING POSITION

FIG. 5.
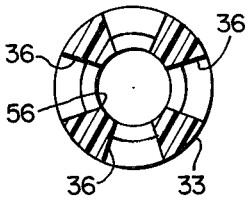
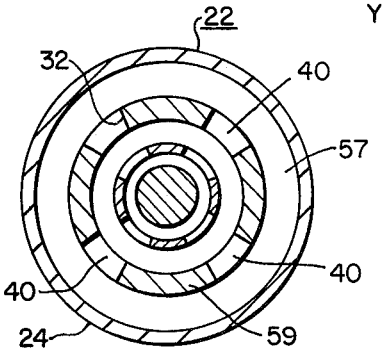
FIG. 6.
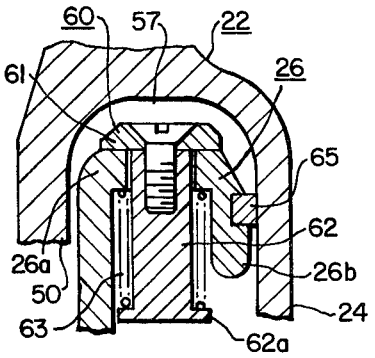
FIG. 7.
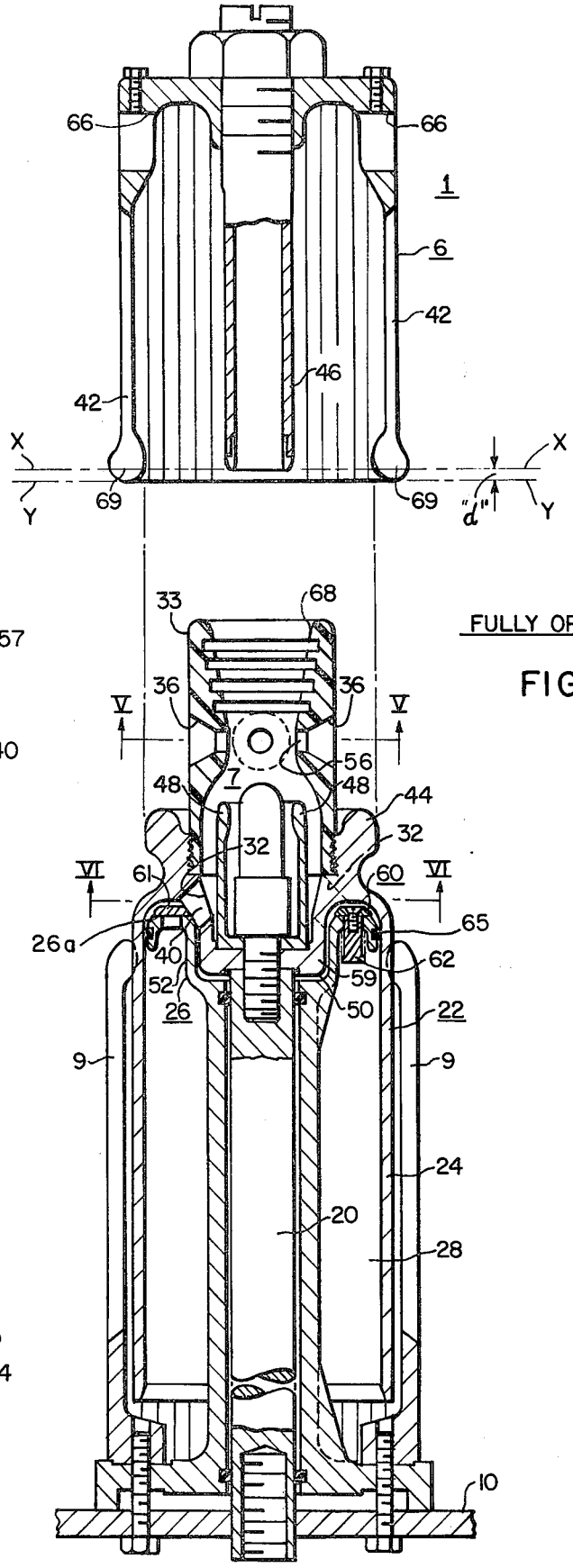
FULLY OPEN
FIG. 4.

PUFFER-TYPE COMPRESSED-GAS CIRCUIT INTERRUPTER

CROSS-REFERENCES TO RELATED APPLICATIONS

Reference may be made to United States patent application Ser. No. 576,820, filed May 12, 1975, now U.S. Pat. No. 3,987,262, issued Oct. 19, 1976 to Joseph Rostron, entitled, "Puffer-Type Gas-Blast Circuit-Interrupter Having Variable-Area Stationary Composite Piston Structure." Additionally, reference may be made to U.S. patent application Ser. No. 602,705 filed Aug. 7, 1975, by Charles Cromer et al, entitled "Improved Puffer-Type Compressed-Gas Circuit-Interrupter," both of said patent applications being assigned to the assignee of the instant patent application.

BACKGROUND OF THE INVENTION

The present invention is particularly related to puffer-type compressed-gas circuit-interrupters of the type in which only a single pressure is utilized within the interrupting structure, and a difference of pressure for arc interruption is achieved by piston action, that is, relative movement of a gas-operating cylinder to a piston structure. Attention may be directed to U.S. Pat. Nos. 3,839,613 — Tsubaki et al; 3,602,670 — Calvino Teijeiro; 3,849,616 — Calvino Teijeiro; 3,670,124 — Calvino Teijeiro; 3,670,125 — Calvino Teijeiro; and 3,712,969 — Calvino Teijeiro.

As well known by those skilled in the art, the relative motion between the movable operating cylinder assembly and the fixed piston structure achieves a desirable compression of gas within the compression chamber, which compressed gas is utilized during arc interruption by generally forcing the compressed high-pressure gas through a movable hollow insulating nozzle structure to direct the high-pressure gas flow intimately into effective engagement with the established arc within the movable insulating nozzle throat to effect the latter's extinction.

DESCRIPTION OF THE PRIOR ART

The present invention relates to puffer-type circuit-interrupters of the type set forth in U.S. Pat. No. 3,551,623, issued Dec. 29, 1970, to Robert G. Colclaser, Jr. and William H. Fischer. This patent shows the relative motion of a movable piston within a relatively stationary operating cylinder, with electromagnetic coils energizing a companion movable piston, which is electrically repelled toward the first-mentioned movable piston, the latter being attached to, and movable with, a contact-operating rod.

As well known by those skilled in the art, there are many patents treating different piston structures, for example, U.S. Pat. No. 2,429,311, issued Oct. 21, 1947, to M. J. Gay; and U.S. Pat. No. 3,786,215, issued Jan. 15, 1974 to Gerhard Mauphe.

An additional patent of interest in connection with piston structures in U.S. Pat. No. 3,331,935, issued July 18, 1967 to Stanislaw A. Milianowicz. Another piston patent, utilizing hydraulic action for effecting piston motion, is U.S. Pat. No. 2,913,559, issued Nov. 17, 1959, to Charles F. Cromer.

An additional patent of interest is German Patent No. 671,326 patented in Germany, October 1937. All of the aforesaid patents indicate that piston structures of the prior art are well known, but many have deficiencies of complexity, of being rather slow in operation and also, importantly, susceptible to high-voltage breakdown. In addition, back-pressure gas conditions may easily arise, which renders the circuit-interrupter, as a whole, relatively slow-acting in operation, generally taking perhaps 8 cycles to effect circuit interruption.

BRIEF SUMMARY OF THE INVENTION

An improved puffer-type gas-blast circuit-interrupter is provided having a relatively stationary contact structure cooperable with a movable contact structure, the latter being affixed to, and movable with, a movable operating cylinder assembly. The movable operating cylinder assembly moves, or operatively slides, over a relatively-fixed piston structure.

A high gas-compression ratio is obtained so that upon the completion of the opening stroke of the movable operating cylinder assembly, there is a minimization of the "dead" volume, or compression space available for arc-quenching gas, this giving rise to the improved high-pressure gas-flow conditions through the insulating movable nozzle, through which the established arc is drawn.

Another feature of the present invention is the provision of an improved efficient gas-flow path through the movable cylinder assembly smoothly converging into the restricted nozzle throat area.

Another important feature of the present invention is the provision of a generous radius provided on the projecting ends of the main stationary contact fingers, and the shrouding, or shielding of the stationary arcing probe within this surrounding cluster of main stationary contact fingers.

Still another important feature of the present invention is the ready adaptation of the circuit-interrupter of the present invention to different current ratings by simply increasing the number of surrounding stationary contact fingers used bearing upon the outer sides of the metallic movable gas-operating cylinder.

BRIEF DESCRIPTION OF THE DRAWINGS

FIG. 4 shows to an enlarged scale the fully open-circuit position of the interrupter;

FIGS. 5 and 6 are fragmentary sectional views taken along the respective lines V—V and VI—VI of FIG. 1; and, FIG. 7 is an enlarged detailed sectional view illustrating the one-way-acting valve structure associated with the fixed piston structure, the view showing the valve structure in its closed-circuit position during a compressing stroke of the gas-operating cylinder.

DESCRIPTION OF THE PREFERRED EMBODIMENTS

Figure 1:
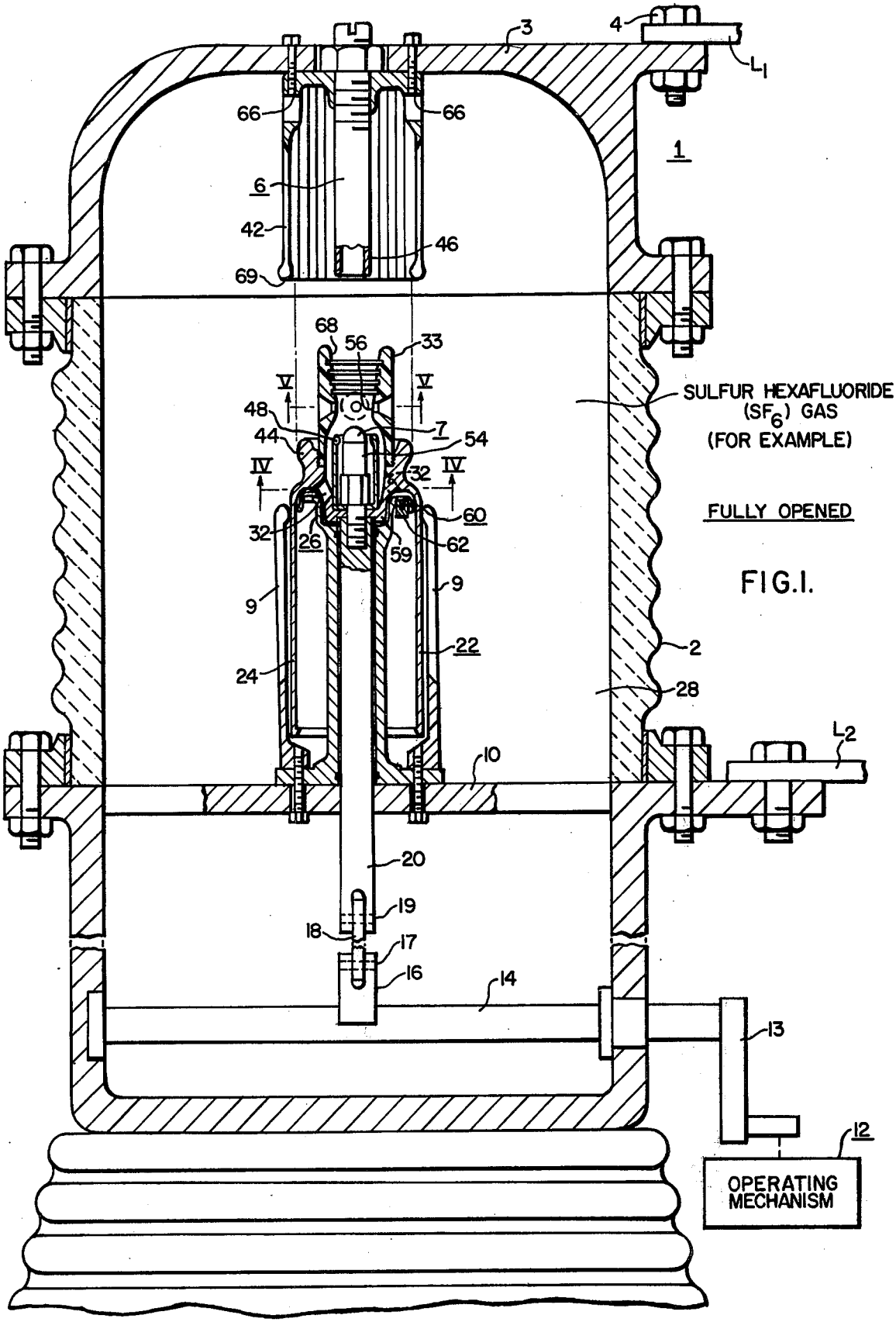
FIG. 1 is a vertical sectional view taken through one embodiment of the present invention illustrating a gas-blast puffer-type circuit-interrupter with the separable contacts illustrated in the fully-open-circuit position.
Figure 2:
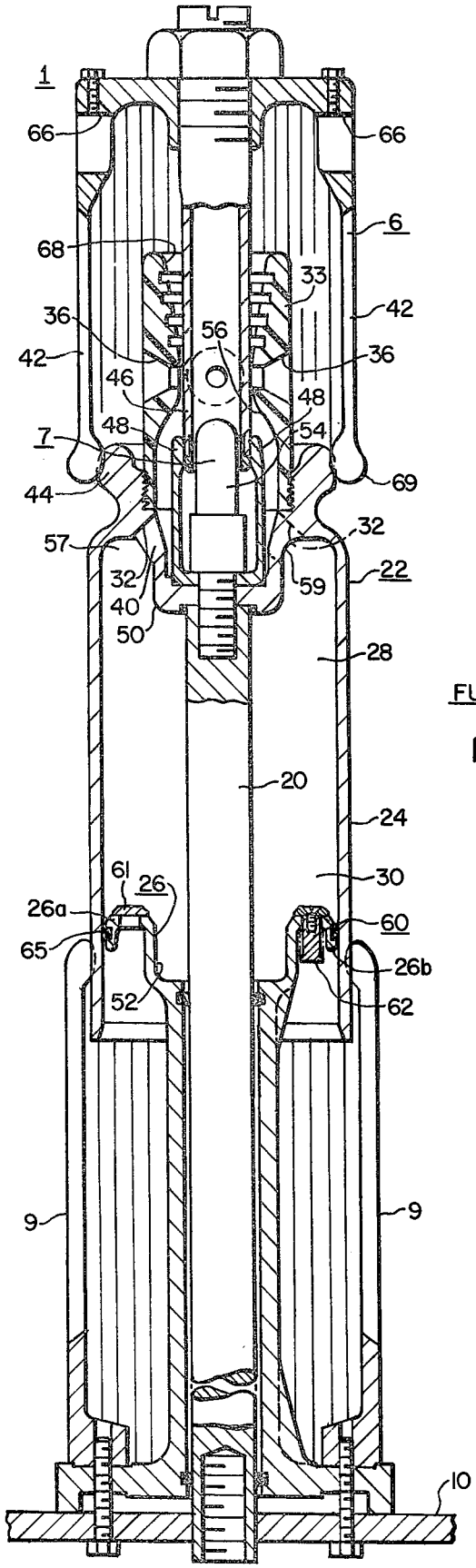
FIG. 2 is a view similar to that of FIG. 1, but illustrating the disposition of the several component parts in the closed-circuit position of the circuit-interrupter.
Figure 3:
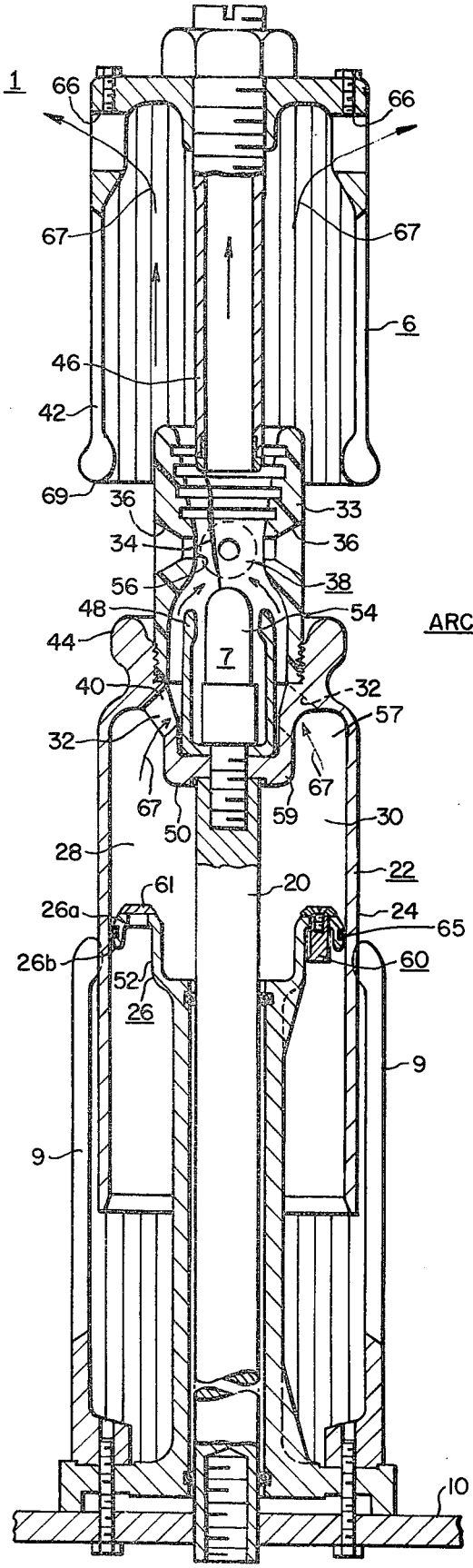
FIG. 3 is a sectional view illustrating the stage of arcing during the opening operation.

Referring to the drawings, and more particularly to FIGS. 1-3 thereof, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$. Extending downwardly-interiorly of the conducting dome-shaped casting 3 within the casing 2 is a relatively stationary contact structure, designated by the reference numeral 6, and cooperable in the closed-circuit position with a movable contact structure 7, as illustrated more clearly in FIG. 2 of the drawings. The movable contact structure 7 is electrically connected, by a plurality of sliding finger contacts 9, to a generally-horizontally-extending conducting support plate 10, which provides a second line terminal $L_2$ disposed externally of the casing 2, as again shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally-disposed rotative crank-arm 16, which is pivotally connected, as at 17, to a floating link 18, the latter being pivotally connected, as at 19, to the lower end of a linearly-movable contact-operating rod 20.

It will be noted that the upper end of the contact-operating rod 20 forms the movable contact structure 7 itself, which, as mentioned heretofore, makes contacting closed-circuit engagement with the stationary contact structure 6 in the closed-circuit position of the interrupting device 1, as illustrated in FIG. 2.

A movable gas-operating cylinder assembly 22 is provided having a large-diameter, downwardly-extending movable sleeve portion 24, which slidably moves over a relatively fixed piston structure 26, as again illustrated in FIG. 2.

During the opening operation, it will be observed that the movable operating cylinder 22 moves downwardly over the relatively fixed piston structure 26 compressing gas 28 within the region 30 (FIG. 2), and forcing it to flow upwardly through the vent openings 32 and through the movable insulating nozzle 33, through which an arc 34 is drawn, as shown in FIG. 3.

With reference to the nozzle 33, it will be observed that there is provided a plurality, say in this particular instance four, vent openings 36 to enable the hot arc gases to quickly vent from the arcing region 38 (FIG. 3) to thereby enable a desirable cooling action to take place. Reference may be made to United States Pat. No. 3,291,948, issued Dec. 13, 1966 to Telford, in this connection.

FIG. 6 more clearly shows a sectional view taken through the movable operating cylinder 22, indicating the wide venting area 40 in vent openings 32 to provide unimpeded flow of high-pressure gas 28 from the compression area 30 (FIG. 2) within the movable operating cylinder 22, upwardly through the vent openings 32 and into the movable nozzle structure 33, where arc-extinction quickly takes place.

The stationary main contact fingers 42 make contacting engagement in the closed-circuit position, as illustrated in FIG. 2, with an annular main movable contact portion 44. During the opening operation of the puffer interrupter 1, the main stationary contact fingers 42 part company with the annular movable main contacting portion 44, so that thereafter contact is only maintained between the stationary tubular arcing contact 46 and movable secondary arcing contact fingers 48, as illustrated in FIG. 2.

Downward continued opening motion of the conducting operating rod 20, as effected by the operating mechanism 12, continues to force the movable operating cylinder 22 downwardly over the stationary piston structure 26, thereby providing an upward flow of compressed gas through the movable nozzle 33. It will be observed that a downwardly-extending movable boss portion 50 enters a stationary cavity 52 provided generally centrally of the relatively fixed piston structure 26 and thereby provides a mating, closing interengagement between the two structures to thereby minimize the "dead" volume of confined gas within piston space 30. This is desirable inasmuch as a higher gas-compression ratio is thereby achieved.

During the closing operation of the puffer interrupter 1, the movable gas-operating cylinder 22 moves upwardly, and carries with it the annular main movable contact 44 together with the movable secondary arcing fingers 48. First an interengagement is made between the tubular stationary arcing contact 46 and the cluster of movable secondary arcing fingers 48. This contacting interengagement prevents a subsequent prestriking condition occurring between the main stationary contact fingers 42 and the main annular contact portion 44. Thus, there is no arcing occurring, or permitted whatsoever at the main stationary contact fingers 42 and the annular main movable contact 44, all arcing 34 being confined to the stationary tubular arcing contact 46 and the movable arcing contact probe 54 to prevent arc erosion occurring at the main contacts 42, 44.

The gas-flow path through the movable operating cylinder 22 and the movable insulating nozzle 33 presents an efficiently-shaped contour, with steadily decreasing gas-flow area reaching the minimum, or critical flow area preferably only at the nozzle throat opening 56.

At the end of the opening stroke, the annular section 26*a* of the stationary piston 26 extends into the volume 57 between the spider 59 and the cylinder-inside diameter, continuing to compress the gas 28 into a minimum volume not otherwise obtainable. This provides for the maximum driving pressure of the gas 28 through the interrupting region 38 and the insulating nozzle 33.

FIG. 7 fragmentarily shows a one-way-acting valve structure 60 comprising an annular ring 61, which is affixed to a plurality of circularly-spaced spring-rod portions 62 having lower flange portions 62*a* . Compression springs 63 are interposed between the flange portions 62*a* and the boss portion 26*a* of the fixed piston structure 26. Desirably, a piston ring 65 may be provided, as also shown in FIG. 7, thereby enabling a guiding action to be obtained between the skirt portion 24 of the movable gas-operating cylinder 22 and the outer annular portion 26*b* of the fixed piston structure 26, as again shown more clearly in FIG. 7.

During the upward closing operation of the interrupter 1, the annular valve-plate 61 opens and permits gas to flow into the region 30 within the movable gas-operating cylinder 22. During the downward opening compressing stroke of the gas-operating cylinder 22, on the other hand, the valve-ring 61 closes and gas compression takes place within the region 30.

It will be noted that a plurality of circumferentially-disposed venting holes 66 are provided at the upper end of the relatively-stationary cluster main contact finger assembly 42, as illustrated in FIGS. 1–3 of the drawings. This provides a desired cooling action for the arcing gases which are ejected upwardly, as shown by the arrows 67 in FIG. 3. FIG. 3, of course, indicates the arcing condition, where the compressed gas 28 is forced upwardly out of the mouth 68 of the insulating nozzle 33 and upwardly within the main stationary cluster fingers 42. This gas may readily be ejected out of the circumferentially-spaced holes 66 disposed at the upper end of the main stationary finger casting 42.

It will also be apparent that a generous radius 69 is provided at the lower end of the main stationary contact fingers 42 to result in a high electrical-withstand capability being attributable to the circuit-interrupter 1, and by hiding, or shrouding the stationary tubular arcing probe 46 within the surrounding cluster of main stationary contact fingers 42, as shown in FIG. 1. In more detail, with reference being directed to FIG. 4 of the drawings, it will be observed that the centrally-disposed tubular arcing contact 46 has its forward projecting end 46*a* in an imaginary plane "X—X," terminating rearwardly a vertical distance "*d*" from an imaginary plane "Y—Y" passing through the tips 69 of the main stationary contact fingers 42, for a consequent desirable electrostatic shielding of the arcing contact 46 in the open-circuit position of the circuit interrupter to prevent voltage flashover between the separated contacts 46, 54.

By providing a greater number of surrounding main stationary contact fingers 9, a higher current-carrying capacity interrupter may be provided. The interrupter combines high electrical withstand, say, for example, 900 kV BIL, with high continuous currents, such as, for example, 4 kA and high-fault clearing capabilities, such as 50 kA.

The full complement of stationary main contact fingers 9, and the interrupter "bottle" 22 and the auxiliary fingers 42 provide heavy-material cross-sections, with low resistive drops to high continuous currents. The number of auxiliary fingers is variable, as necessary, to optimize the design for various continuous currents up to 4 kA, for example, without forced cooling.

The high interrupting performance is obtained with a reduced residual volume at the end of the opening stroke, and consequently a higher compression ratio. This is a single-flow design with the gas-flow cross-section gradually reducing, starting from the piston head 26 through the ports and passages 32 to the nozzle throat 56 minimizes all pressure drops up to the nozzle throat, where the arc 34 is extinguished. The performance is thus maximized. The gas flow downstream of the nozzle 33 is confined within the stationary main contact fingers 42 and thus cools the gas 28 to prevent high-voltage breakdown to electrical members at another potential. The open ports 66 at the upper end of the stationary main finger cluster 42 prevents stagnation of the gas flowing into the stationary finger cluster 42, which permits the hot gases to be blown out of the way to insure good interrupting performance.

From the foregoing description it will be apparent that there has been provided an improved puffer-type circuit-interrupter 1 in which improved gas-flow conditions are achieved with the minimization of the "dead" gas volume 30, or space within the movable gas-operating cylinder 22 at the end of the opening stroke of the circuit-interrupter 1. It will be observed that the gas-flow paths are open and unimpeded passing upwardly past the cluster of movable arcing fingers 48 and through the throat-restricting portion 56 of the insulating nozzle 33 where arc-extinction is quickly achieved. Also, it will be observed that the heated gas is cooled by the stationary cluster of main stationary contact fingers 42.

Although there has been illustrated and described a specific structure, it is to be clearly understood that the same was merely for the purpose of illustration, and that changes and modifications may readily be made therein by those skilled in the art, without departing from the spirit and scope of the invention.

We claim:

1. A puffer-type compressed-gas circuit-interrupter adaptable for high-current ratings including means defining a generally-cup-shaped metallic support for supporting a relatively-stationary contact structure (6), said relatively-stationary contact structure (6) including a cluster of stationary main contact fingers (42) disposed in a generally cylindrical arrangement and a centrally-disposed stationary tubular venting arcing contact (46), venting means (66) provided at the rear end of said generally-cup-shaped metallic support for freely venting arced gases during the opening operation of the circuit-interrupter, means defining a cooperable movable contact structure (7) comprising a movable solid arcing contact (54) and a cluster of movable secondary contact arcing fingers (48) surrounding said movable solid arcing contact (54), a movable operating-cylinder assembly (22) carrying said movable contact structure (6) and an insulating nozzle, said movable operating-cylinder assembly (22) having disposed thereon adjacent its forward end an annular relatively-heavy movable main contact (44) making cooperable engagement with said cluster of stationary main contact fingers (42) in the closed-circuit position of the circuit-interrupter, means defining a relatively-fixed piston member (26), said movable operating-cylinder assembly (22) slidable over said relatively-fixed piston member (26) during the opening operation, the relatively heavy movable main contact (44) making separable engagement from said stationary main contact fingers (42) prior in point of time to the subsequent separation of the movable arcing secondary contact fingers from said centrally-disposed stationary tubular venting arcing contact (46) so that arcing occurs only between the stationary tubular arcing contact (46) and the solid movable arcing contact (54) within said nozzle, the forward extending ends of the stationary main contact fingers (42) having enlarged rounded portions (69) to enable the circuit-interrupter to have a high electrical voltage-withstand capability, the forward end (46*a*) of said centrally-disposed stationary tubular venting arcing contact (46) terminating rearwardly of an imaginary plane ("Y—Y") passing through the tips (69) of the main stationary contact fingers 42, and compressed gas being permitted to freely flow at the initial time of arc establishment between the movable arcing plug contact (54) and the stationary tubular venting contact (46).

2. A puffer-type compressed-gas circuit-interrupter adaptable for high-current ratings including means defining a generally-cup-shaped metallic support for supporting a relatively-stationary contact structure (6), said relatively-stationary contact structure (6) including a cluster of stationary main contact fingers (42) disposed in a generally cylindrical arrangement and a centrally-disposed stationary tubular venting arcing contact (46), venting means (66) provided at the rear end of said generally-cup-shaped metallic support for freely venting arced gases during the opening operation of the circuit-interrupter, means defining a cooperable movable contact structure (7) comprising a movable solid arcing contact (54) and a cluster of movable secondary contact arcing fingers (48) surrounding said movable solid arcing contact (54), a movable operating-cylinder assembly (22) carrying said movable contact structure (6) and an insulating nozzle, said movable operating-cylinder assembly (22) having disposed thereon adjacent its forward end an annular relatively-heavy movable main contact (44) making cooperable engagement with said cluster of stationary main contact fingers (42) in the closed-circuit position of the circuit-interrupter, means defining a relatively-fixed piston member (26), said movable operating-cylinder assembly (22) slidable over said relatively-fixed piston member (26) during the opening operation; said relatively-fixed piston member (26) having one-way acting valve means disposed at its forward end facing the relatively stationary contact means so that gas may be admitted within the piston chamber (30) during the closing operation of the compressed-gas circuit-interrupter, the forward end (46*a*) of said centrally-disposed stationary tubular venting arcing contact (46) terminating rearwardly of an imaginary plane ("Y—Y") passing through the tips (69) of the main stationary contact fingers 42, and compressed gas being permitted to freely flow at the initial time of arc establishment between the movable arcing plug contact (54) and the stationary tubular venting contact (46).

3. The combination according to claim 1, wherein a ring-shaped check-valve plate is provided on the stationary piston having a spring-return operation.

4. The combination according to claim 1, wherein a light-weight non-current-carrying operating shaft (20) operates the movable operating cylinder.

5. The combination according to claim 1, wherein the gas-flow areas upstream of the nozzle-throat gradually decreases thereby minimizes pressure-drops and increases the pressure at the nozzle which improves interrupting performance.

6. A puffer-type compressed-gas circuit-interrupter adaptable for high-current ratings including means defining a generally-cup-shaped metallic support for supporting a relatively stationary contact structure (6), said relatively-stationary contact structure (6) including a cluster of stationary main contact fingers (42) disposed in a generally cylindrical arrangement and a centrally-disposed stationary tubular venting arcing contact (46), ventng means (66) provided at the rear end of said generally-cup-shaped metallic support for freely venting arced gases during the opening operation of the circuit-interrupter, means defining a cooperable movable contact structure (7) comprising a movable solid arcing contact (54) and a cluster of movable secondary contact arcing fingers (48) surrounding said movable solid arcing contact (54), a movable operating-cylinder assembly (22) carrying said movable contact structure (6) and an insulating nozzle, said movable operating-cylinder assembly (22) having disposed thereon adjacent its forward end an annular relatively-heavy movable main contact (44) making cooperable engagement with said cluster of stationary main contact fingers (42) in the closed-circuit position of the circuit-interrupter, means defining a relatively-fixed piston member (26), said movable operating-cylinder assembly (22) slidable over said relatively-fixed piston member (26) during the opening operation, said movable contact assembly (6) additionally carrying said centrally-disposed movable solid arcing contact probe (54) at its forward end which enters the stationary tubular venting arcing contact (46) in the closed-circuit position of the device, gas being compressed between the movable operating cylinder and the relatively fixed piston to be forced out of the movable cylinder assembly through said hollow insulating nozzle (33) and into engagement with the established arc drawn within the hollow movable nozzle (33) and between the stationary tubular venting arcing contact (46) and the movable solid arcing contact probe (54) during the opening of the device; and a large radius being provided on the forward ends of the main stationary contact fingers to increase the voltage-withstand capability of the device, the forward end (46*a*) of said centrally-disposed stationary tubular venting arcing contact (46) terminating rearwardly of an imaginary plane ("Y—Y") passing through the tips (69) of the main stationary contact fingers 42, and compressed gas being permitted to freely flow at the initial time of arc establishment between the movable arcing plug contact (54) and the stationary tubular venting contact (46).

7. The combination according to claim 1, wherein a plurality of guide-rings (65) are supported by the piston structure and provide guiding for the movable operating shaft, thus generating the required straight-line motion for the interrupting cylinder.

8. The combination according to claim 1, wherein a variable number of stationary main contact fingers (9) may be employed bearing upon the metallic operating cylinder (24) for varying the current capability of the circuit interrupter in its operation.

* * * * *